US007789155B2

(12) United States Patent
Moncus et al.

(10) Patent No.: US 7,789,155 B2
(45) Date of Patent: Sep. 7, 2010

(54) COILED TUBING WELL INTERVENTION SYSTEM AND METHOD

(75) Inventors: James Devin Moncus, Lafayette, LA (US); Joseph Hayden Miller, Jr., Lafayette, LA (US)

(73) Assignee: Devin International, Inc., Lafayette, LA (US)

( * ) Notice: Subject to any disclaimer, the term of this patent is extended or adjusted under 35 U.S.C. 154(b) by 162 days.

(21) Appl. No.: 12/074,734

(22) Filed: Mar. 6, 2008

(65) Prior Publication Data

US 2009/0223679 A1 Sep. 10, 2009

(51) Int. Cl.
*E21B 19/00* (2006.01)

(52) U.S. Cl. ..... 166/313; 166/77.2; 166/384

(58) Field of Classification Search ..... 166/384, 166/313, 77.2; 175/52
See application file for complete search history.

(56) References Cited

U.S. PATENT DOCUMENTS

| | | | | |
|---|---|---|---|---|
| 6,973,979 | B2 * | 12/2005 | Carriere et al. | 175/203 |
| 7,096,963 | B2 | 8/2006 | Moncus et al. | |
| 2001/0025727 | A1 * | 10/2001 | Byrt et al. | 175/7 |

* cited by examiner

*Primary Examiner*—Jennifer H Gay
*Assistant Examiner*—Kipp C Wallace
(74) *Attorney, Agent, or Firm*—Jones Walker

(57) ABSTRACT

An apparatus having a modular support frame with a top deck. The top deck has a passage therein. A tower is mounted on the top deck. A moveable plate and a track are positioned within the passage. The movable plate is slidingly attached to the track. A support rotary table is disposed within the modular support frame and suspends jointed tubulars. A coiled tubing injector head interface plate is operatively attached to the movable plate, and positioned over the first aperture of the movable plate. The first aperture is positioned over the well in a first position. A rotary table is positioned over the well in a second position. Well intervention work is conducted with the coiled tubing and jointed tubulars.

15 Claims, 5 Drawing Sheets

COILED TUBING WELL INTERVENTION SYSTEM AND METHOD

BACKGROUND OF THE INVENTION

This invention relates to an apparatus and method for performing well intervention work. More particularly, but not by way of limitation, this invention relates to an apparatus and method for performing coiled tubing well intervention operations with jointed tubulars from a platform.

In the drilling, completion and production of hydrocarbons, an operator may find it necessary to perform various well intervention work. Prior art techniques of performing well intervention work include utilizing traditional drilling rigs and snubbing units. As well understood by those of ordinary skill in the art, drilling rigs and snubbing units produce a large foot print and the cost can be quite significant. Put another way, well intervention work with a drilling rig and/or snubbing units can be very expensive.

One alternative to the large and expensive rigs is for an operator to utilize coiled tubing. As appreciated by those of ordinary skill in the art, coiled tubing units require less space (i.e. smaller foot print), easier to transport, and are more economical to operate. Coiled tubing can be used to perform many well intervention techniques, including but not limited to, drilling, completion, work overs, plug and abandonments, etc. Hence, coiled tubing use is encouraged.

Despite these advantages, coiled tubing use does have some disadvantages. For instance, in the course of performing well intervention work, an operator may find it necessary to utilize jointed pipe. In the case where jointed pipe is used, an operator will need to lift, lower, make-up, break-out, etc the jointed pipe, and coiled tubing units are not suited for this type of activity. In other words, use of coiled tubing units presents pipe handling problems such as lifting and lowering jointed pipe that is being used in conjunction with the coiled tubing. In the prior art, traditional derricks of drilling rigs have been utilized. However, if a traditional derrick is used along with a coiled tubing unit, a lot of the cost saving associated with using the coiled tubing unit is minimized.

Therefore, there is a need for an apparatus and method that can assist a coiled tubing unit in the drilling, completing, working-over, producing of a well, plug and abandonment of a well, etc. There is also a need for an apparatus and method for performing coiled tubing well intervention operations with jointed tubulars from a platform. These needs, as well as many others, will be apparent from the following description.

SUMMARY OF THE INVENTION

An apparatus for performing well intervention work with coiled tubing and jointed tubulars from a platform is disclosed. The apparatus comprises a modular support frame with a top deck, wherein the deck has a passage therein, and a tower mounted on the top deck. The apparatus further comprises a movable plate positioned within the passage, with the movable plate having a first aperture and a second aperture therein, and a track formed within the passage, and wherein the movable plate is slidingly attached to the track. The apparatus may further comprise a support rotary table disposed within the modular support frame, wherein the support rotary table suspends and rotates the jointed tubulars. The apparatus may further comprise a coiled tubing injector head interface plate operatively attached to the movable plate, and wherein the coiled tubing injector head plate is operatively associated with the first aperture of the movable plate. The coiled tubing injector head interface plate is positioned over the well in a first position.

The apparatus may also include means for moving the movable plate relative to the top deck. The moving means may include a hydraulic piston and a hydraulic supply. In a second position, the rotary support table is positioned over the well, and the second aperture is positioned over the rotary support table. Also, the coiled tubing injector head interface plate, in one embodiment, is laterally movable over the first aperture. The support rotary table may include a slot for entry of the jointed pipe, and wherein the rotary support table supports the joined pipe. In the most preferred embodiment, the tower is a three legged member.

Also disclosed is a method of performing well intervention work with a coiled tubing unit and jointed pipe from a platform, with the platform having a subterranean well extending therefrom. The method includes providing an apparatus, with the apparatus comprising: a modular support frame with a top deck, and wherein the top deck has a passage therein; a tower mounted on said top deck; a movable plate positioned within the passage, the movable plate having a first aperture and a second aperture therein; a coiled tubing injector head interface plate operatively attached to the movable plate, and wherein the coiled tubing injector head plate is positioned over the first aperture of the movable plate; and the interface plate is positioned over the well. The method further comprises moving the moving plate so that the interface plate is no longer positioned over the well, positioning the second aperture over the well, picking-up a first jointed tubular with the tower, moving a rotary table over the well, and lowering the first jointed tubular through the second aperture and into the rotary table with the tower.

The method further comprises picking-up a second jointed tubular with the tower, lowering the second jointed tubular through the second aperture with the tower, making-up the first and the second jointed tubular with the rotary table and lowering the first and the second jointed tubular with the tower into the well. The method further comprises suspending the second jointed tubular within the well, moving the rotary table away from the well, moving the moving plate so that the interface plate is positioned over the well, rigging-up the coiled tubing injector head to the well so that the coiled tubing can be run into the well and performing well intervention work with the coiled tubing and the jointed tubulars.

In one preferred embodiment, the step of making-up the first and the second jointed tubulars includes supporting the jointed pipe within the rotary table disposed within the modular support frame and rotating the second jointed pipe relative to the first jointed pipe in order to make-up the jointed tubular. In yet another embodiment, a track is formed within the passage, and wherein the movable plate is slidingly attached to the track, and the method further comprises sliding the moving plate along the track so that the injector interface plate is in the position over the well and rigging up the coiled tubing injector head to the well.

An advantage of the present invention is that the system disclosed allows an operator to utilize coiled tubing and jointed pipe together in an operational environment. Yet another advantage is that the apparatus can be used on offshore platforms. Yet another advantage is that the well intervention work utilizing the apparatus and method do not require a drilling rig. Still yet another advantage is that rigging up and rigging down of a coiled tubing unit is facilitated.

A feature of the present invention is the tower used for making-up and breaking-down the jointed tubulars. The tower can also be used for supporting the coiled tubing injector head. In the most preferred embodiment, the tower is a tripod. Another feature is that a rotary table is used for making-up and breaking-down the tubular connections. Yet another feature is the movable plate operatively associated within a passage, wherein the movable plate contains a first and second aperture. Another feature includes the track operatively associated with the passage that cooperates with the movable plate to allow movement of the movable plate. Still yet another feature is the interface plate that connects to a coiled tubing injector head, and wherein the interface plate may be used to hold the coiled tubing injector head as well as position the injector in a correct orientation.

DETAILED DESCRIPTION OF THE PREFERRED EMBODIMENTS

Figure 1:
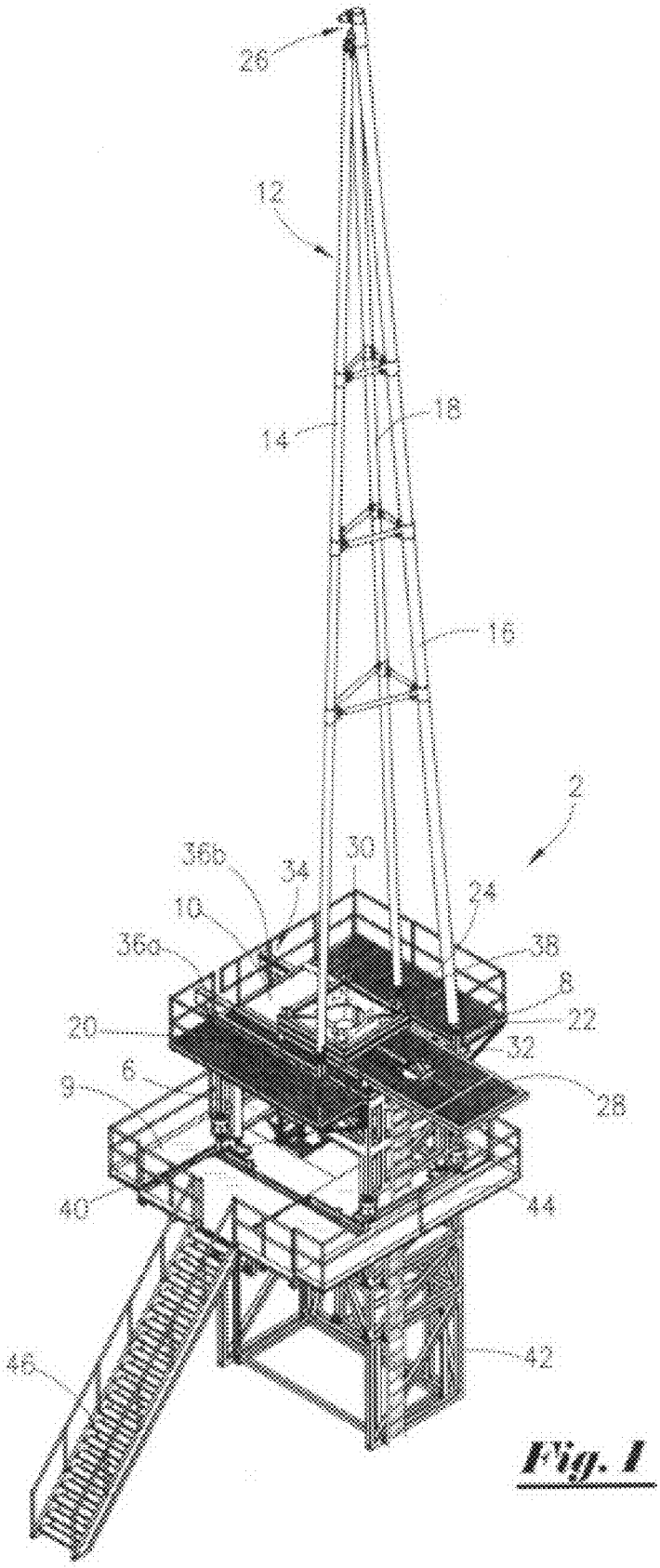
FIG. 1 is a schematic illustration of the most preferred embodiment of the present disclosure.

Referring now to FIG. 1, a schematic illustration of the most preferred embodiment of the present disclosure will now be disclosed. In FIG. 1, the apparatus 2 is situated on a platform (not shown in this view), and wherein the apparatus 2 is capable of performing well intervention operations with a coiled tubing unit (the coiled tubing unit not seen in this view). The apparatus 2 includes a modular support frame 6 with a top deck 8 and bottom deck 9, and wherein the top deck has a passage 10 therein. The apparatus 2 further includes a tower 12 mounted on the top deck 8.

As seen in FIG. 1, in the most preferred embodiment, the tower 12 is a three legged member (sometimes referred to as a tripod 12). The tower 12 includes leg 14, leg 16, and leg 18. Leg 14 is attached to the top deck 8 at 20; leg 16 is attached to the top deck at 22; leg 18 is attached to the top deck 8 at 24. A pulley means 26 is located at the apex of the tower 12, and wherein the pulley means 26 can be used for lifting and lowering various devices, and in particular for lifting and lowering the jointed tubulars, as will be more fully explained later in the disclosure. The tower 12 can also be used to support the coiled tubing injector head.

FIG. 1 also depicts the movable plate 28 positioned within the passage 10, with the movable plate 28 having a first aperture 30 and a second aperture 32 formed therein. A track 34, which comprises a pair of rails 36*a* and 36*b*, are formed within the passage 10 as seen in FIG. 1. The movable plate 28 is slidingly attached to the track 34, and more specifically the movable plate 28 is attached to the rails 36*a*, 36*b*.

A coiled tubing injector head interface plate, seen generally at 38, is operatively attached to the movable plate 28. More specifically, the coiled tubing injector head plate 38 is positioned over and operatively attached to the first aperture 30 of the movable plate 28. In a first position, the coiled tubing injector head interface plate 38 is positioned over the well.

FIG. 1 also depicts the support rotary table 40 disposed within the modular support frame 6, with the support rotary table 40 being capable of rolling into a position (second position) over the well (the well not seen in this view). In operation, the support rotary table 40 will suspend and rotate the jointed tubulars in order to make-up the jointed tubular connections. The support rotary table 40 will also be able to break (i.e. unscrew) the connections, as well understood by those of ordinary skill in the art. In the first position, the coiled tubing injector head interface plate 38 is positioned over the well.

FIG. 1 also depicts the bottom support frame 42, wherein the bottom support frame 42 may be placed on a platform (platform not shown in this view). For instance, the platform may be an offshore platform, and the support frame 42, modular support frame 6 and top deck 8 may be positioned on the platform. Hence, the apparatus 2 is modular and transportable to various remote areas such as offshore platforms. Additionally, FIG. 1 illustrates the walking deck 44 which surrounds the bottom support frame 42, and wherein the walking deck 44 allows for an area for walking as well as a work deck. A stairwell 46 is also provided for allowing walking access from the platform (not shown in this view) to the apparatus 2.

Figure 2:
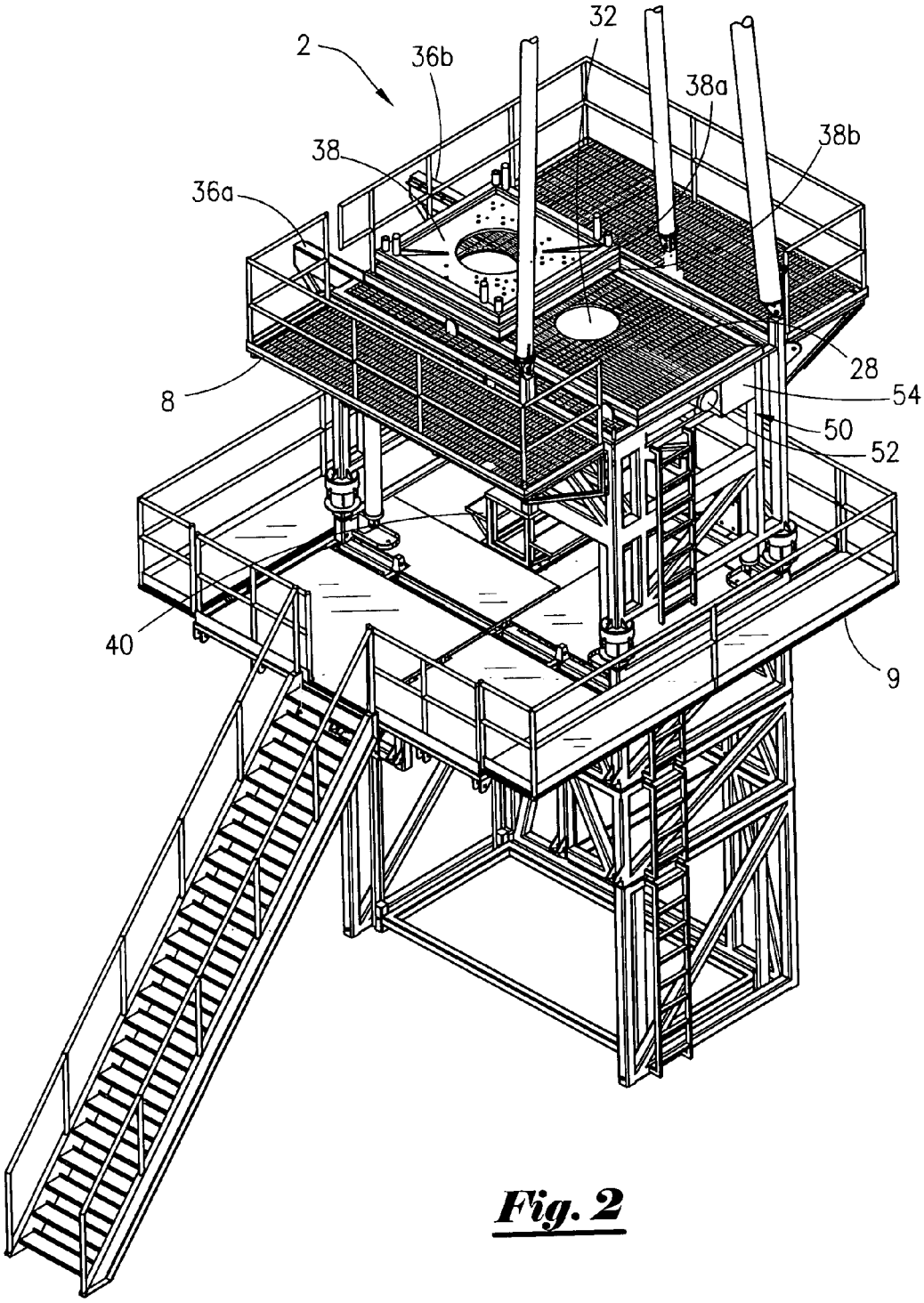
FIG. 2 is an enlarged view of the apparatus seen in FIG. 1.

Referring now to FIG. 2, an enlarged view of the apparatus 2 seen in FIG. 1 will now be described. It should be noted that like numbers appearing in the various figures refer to like components. FIG. 2 depicts a sequential view in that the moveable plate 28 has moved to a second position so that the second aperture 32 is positioned over the well and the support rotary table 40 is also over the well. In other words, in the second position, the second aperture 32 is positioned over the well in FIG. 2, and the support rotary table 40, positioned on the bottom deck 9, is also over the well. As per the teachings of this invention, the operator will be able to lift and lower the jointed tubular members thru the aperture 32 and into engagement with the support rotary table 40. The support rotary table 40 can be moved by rollers operatively associated with a track on the deck 9.

The moveable plate 28 is operatively associated with rails 36*a*, 36*b*, and wherein the moving means 50 for moving the plate 28 relative to the top deck 8 is shown. The moving means 50 will consist of a hydraulic cylinder with piston, seen generally at 52, as well as a hydraulic supply 54 means for supply hydraulic fluid under pressure to the cylinder with piston 52.

FIG. 2 also depicts the interface plate 38. In the most preferred embodiment, the interface plate 38 is generally a pair of plates 38*a*, 38*b* situated one on top of the other, and wherein the plates are laterally movable. The lateral movement of the plate allows an operator to manipulate the exact position of the coiled tubing injector head for assisting in rigging-up and rigging-down procedures of the coiled tubing injector head.

Figure 3:
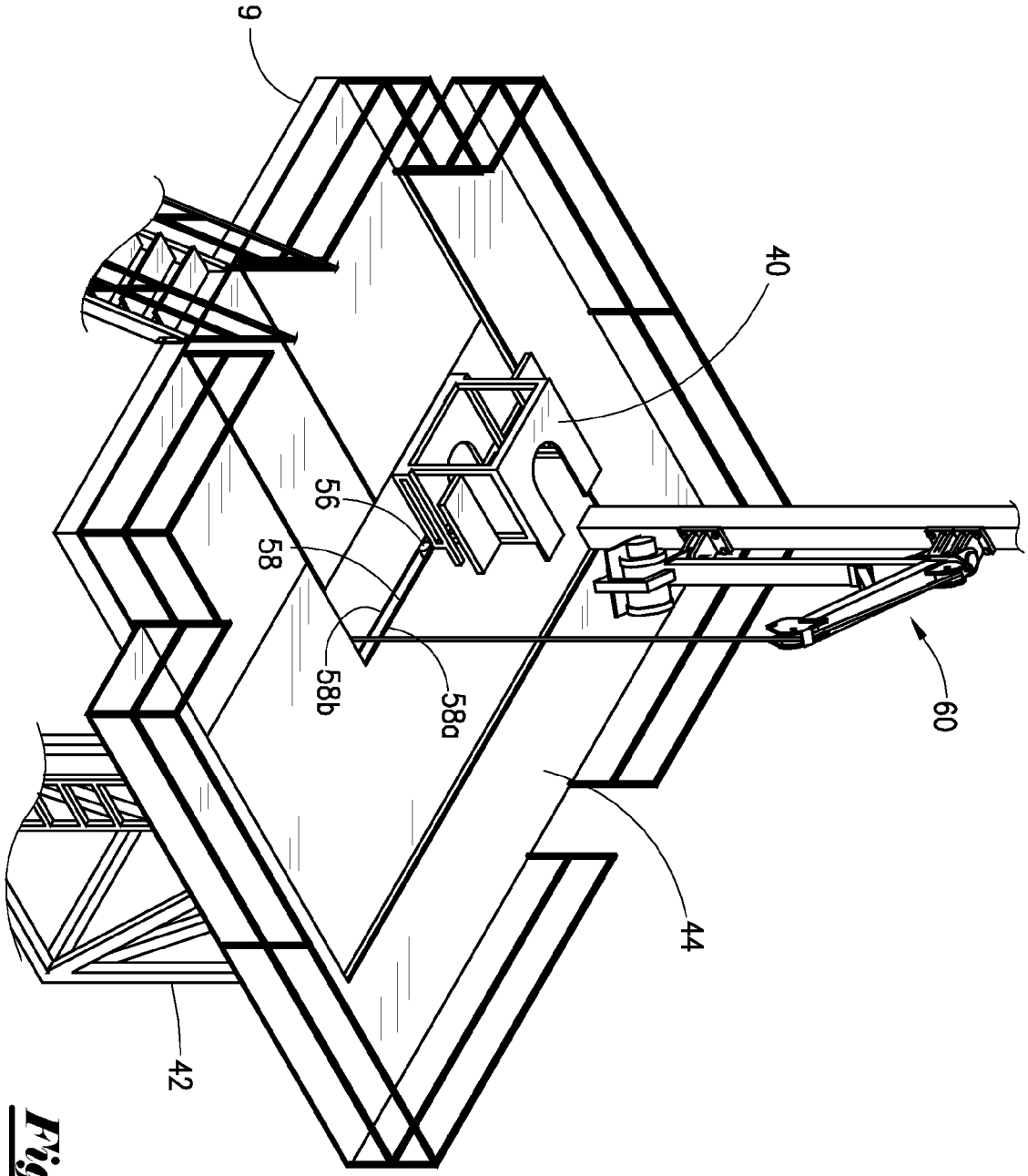
FIG. 3 is a partial view of the apparatus seen in FIG. 1 depicting the rotary table on the intermediate deck.

Referring now to FIG. 3, a partial view of the apparatus 2 seen in FIGS. 1 and 2 depicting the support rotary table 40 on the bottom deck 9 of the modular support frame 6 will now be described. The rollers 56 are operatively associated with the tracks 58*a*, 58*b*, wherein the rollers 56 can be used to roll the support rotary table 40 over the well. As noted earlier, the support rotary table 40 is positioned over the well in the second position. The support rotary table 40 may have operatively associated therewith a set of slips for supporting the jointed pipe during make-up and break-out. The support rotary table 40 may include a driver for providing torque to make-up and break-down the jointed pipe as well understood by those of ordinary skill in the art. A support rotary table 40 is commercially available from National Oilwell Varco Corporation under the name False Rotary Table. The support rotary table 40 is sometimes referred to as a false rotary since rotary tables on drilling rigs are not moveable.

Additionally, FIG. 3 depicts the swing arm crane 60, wherein the swing arm crane 60 can be used for various rigging-up and rigging-down operations. The swing arm crane 60 is described in U.S. Pat. No. 7,096,963, entitled "Swing Arm Crane and Method", which is incorporated herein by express reference.

Figure 4:
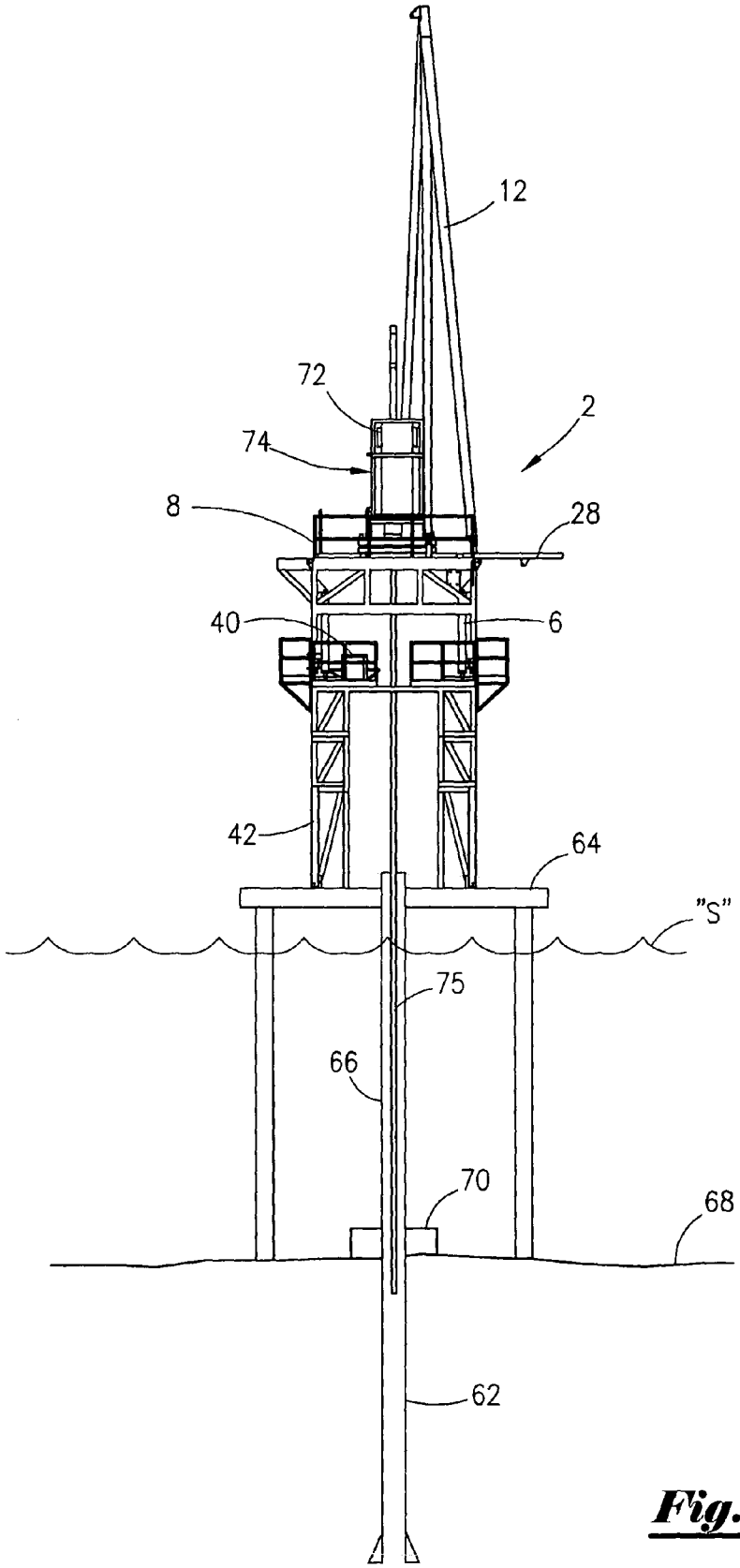
FIG. 4 is a schematic of the present apparatus positioned over a well.

Referring now to FIG. 4, a schematic of the present apparatus 2 positioned over a subterranean well 62 will now be described. The apparatus 2 is situated on a platform 64, and wherein the platform 64 is in offshore waters. The surface of the water is denoted as "S". As understood by those of ordinary skill in the art, a marine riser 66 extends from the sea floor 68 to the platform 64. A sub-sea tree 70 connects the marine riser 66 to the well 62. Hence, the coiled tubing and jointed pipe operations occur concentrically within the marine riser 66 and well 62 as very well understood by those of ordinary skill in the art. The operations may include well intervention procedures such as workovers, completions, plug and abandonments, etc. The moving plate 28 is in the first position such that the coiled tubing injector head 72 of the coil tubing unit 74 is positioned over the well 62. The coiled tubing tubular 75 is shown disposed within the riser 66 and well 62. Note that the coil tubing unit 74 is situated on the top deck 8. The support rotary table 40 is in the first position.

Figure 5:
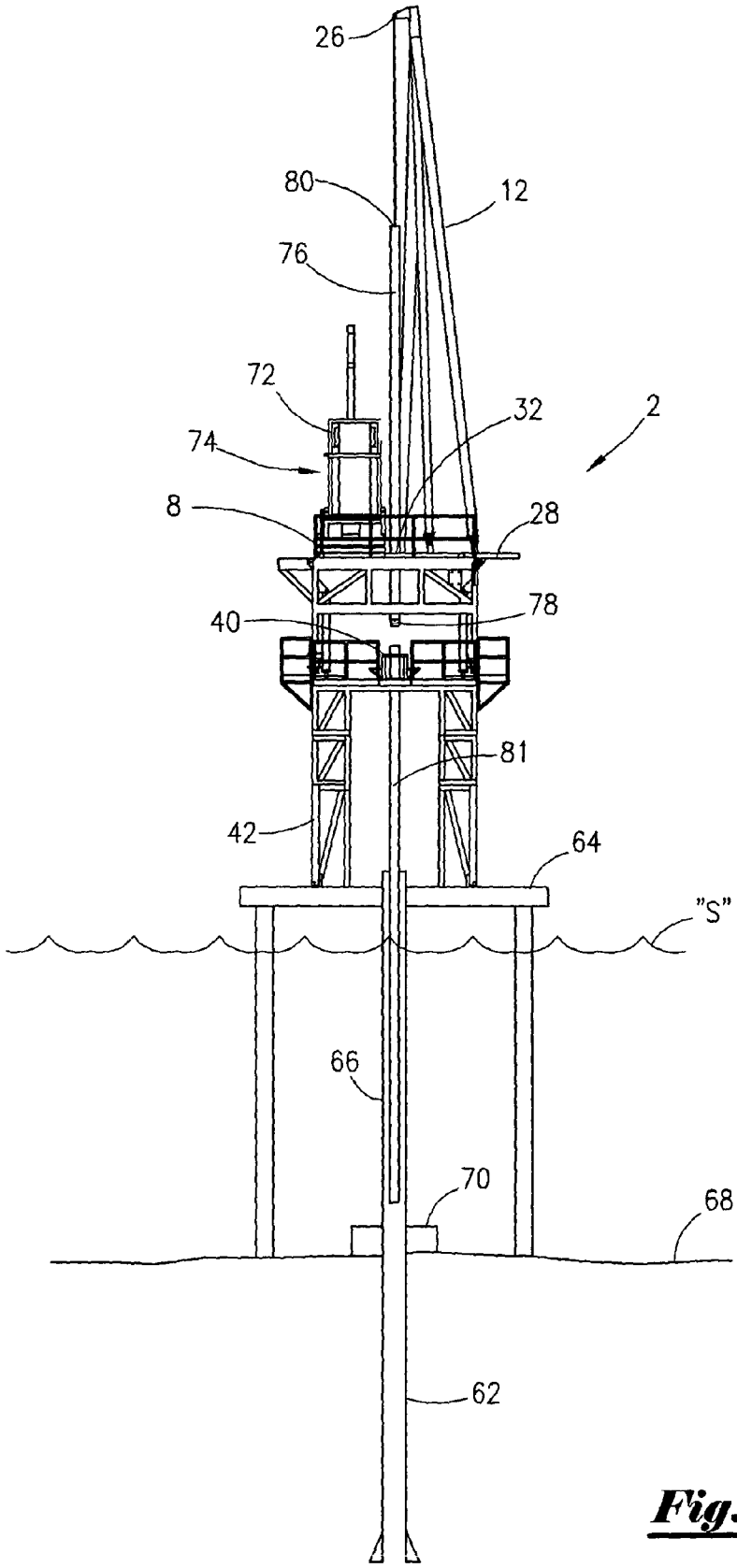
FIG. 5 is a sequential schematic of the apparatus seen in FIG. 4, with the moving plate being moved for insertion of jointed tubulars into the well.

FIG. 5 is a sequential schematic of the apparatus 2 seen in FIG. 4, with the moving plate 28 being moved for insertion of jointed tubulars (such as pipe member 76) into the well 62. In other words, the moving means has been activated, and the movable plate 28 has shifted. The support rotary table 40 is over the well and the second aperture 32 is over the support rotary table 40 (i.e. the second position). It should be noted that the pipe member 76 has a pin (threaded) end 78 and box end 80. Hence, the tower 12 is used to lift a pipe member 76 via pulley means 26, and then the pipe member 76 is inserted thru the second aperture 32. The pipe member 81 is supported within the support rotary table 40, and wherein the jointed tubulars (76 and 81) can be made-up utilizing the support rotary table 40 and the jointed tubulars (76 and 81) can be lowered into the well 62. After utilizing the jointed tubulars in the manner desired by the operator, the rotary support table 40 is rolled away from the well, the moveable plate 28 can be moved again, and the coiled tubing injector head 72 and coiled tubing unit 74 can be rigged-up over the well 62 for continuation of the desired well intervention work. In other words, the coiled tubing injector head 72 is operatively rigged-up to the well so that the coiled tubing can be run into the well (as seen in FIG. 4).

Although the disclosure has been described and illustrated in certain preferred embodiments of the invention, it is to be understood that the invention is not restricted to these particular embodiments. Rather, the invention includes all embodiments, which are functional, or mechanical embodiments of the specific embodiments and features that have been described and illustrated herein.

We claim:

1. An apparatus for performing well intervention operations on a well with a coiled tubing unit and jointed tubulars from a platform, the apparatus comprising:

a modular support frame with a top deck, and wherein said top deck has a passage therein;

a tower mounted on said top deck;

a movable plate positioned within said passage, said movable plate having a first aperture and a second aperture therein;

a track formed within the passage, and wherein said movable plate is slidingly attached to said track;

a coiled tubing injector head interface plate operatively attached to the movable plate, and wherein said coiled tubing injector head plate is positioned over said first aperture of said movable plate, and in a first position, said coiled tubing injector head interface is positioned over the well;

a support rotary table disposed within said modular support frame, wherein said support rotary table suspends the jointed tubulars, and wherein in a second position said support rotary table is positioned over the well, wherein said second aperture is positioned over said support rotary table in the second position.

2. The apparatus of claim 1 wherein said tower is a tripod.

3. The apparatus of claim 2 wherein said coiled tubing injector head interface plate is laterally movable over said first aperture.

4. The apparatus of claim 3 further comprising means for moving said movable plate relative to said top deck.

5. The apparatus of claim 4 wherein said moving means includes a hydraulic piston and a hydraulic supply for said hydraulic piston.

6. The apparatus of claim 5 wherein said support rotary table includes a slot for entry of the jointed pipe and a shoulder, and wherein said shoulder supports the jointed pipe.

7. The apparatus for performing well intervention work to a well with coiled tubing and jointed tubulars from a platform, the apparatus comprising:

a modular support frame with a top deck, and wherein said top deck has a passage therein;

a tower mounted on said top deck;

a movable plate positioned within said passage, said movable plate having a first aperture and a second aperture therein;

a track formed within said passage, and wherein said movable plate is slidingly attached to said track;

a support rotary table disposed within said modular support frame, wherein said support rotary table suspends and rotates the jointed tubulars;

a roller means for rolling said support rotary table over the well;

a coiled tubing injector head interface plate operatively attached to the movable plate, and wherein said coiled tubing injector head plate is positioned over said first aperture of said movable plate and in a first position, said first aperture is positioned over said well, wherein in a second position said second aperture is positioned over said well and said support rotary table.

8. The apparatus of claim 7 wherein said coiled tubing injector head interface plate is laterally movable over said first aperture.

9. The apparatus of claim 7 further comprises means for moving said movable plate relative to said top deck.

10. The apparatus of claim 9 wherein said moving means includes a hydraulic piston and a hydraulic supply.

11. The apparatus of claim 10 wherein said support rotary table includes a slot for entry of the jointed pipe and a shoulder for supporting said jointed pipe, and wherein said shoulder supports the jointed pipe.

12. The apparatus of claim 11 wherein said tower is a three legged member.

13. A method of performing well intervention work with a coiled tubing unit and jointed tubulars platform, with the platform having a subterranean well extending therefrom, the method comprising:

providing an apparatus comprising: a modular support frame with a top deck, and wherein said top deck has a passage therein; a tower mounted on said top deck; a movable plate positioned within said passage, said movable plate having a first aperture and a second aperture therein; a coiled tubing injector head interface plate operatively attached to the movable plate, and wherein said coiled tubing injector head plate is positioned over said first aperture of said movable plate; and the interface plate is positioned over the well;

moving the moving plate so that the interface plate and the first aperture are no longer positioned over the well;

positioning the second aperture over the well;

picking-up a first jointed tubular with the tower;

moving a rotary table over the well;

lowering the first jointed tubular through the second aperture and into said rotary table with the tower;

picking-up a second jointed tubular with the tower;

lowering the second jointed tubular through the second aperture with the tower;

making-up the first and the second jointed tubular with the rotary table;

lowering the first and second jointed tubular with the tower into the well;

moving the rotary table away from the well;

moving the moving plate so that the interface plate is positioned over the well;

rigging-up the coiled tubing injector head to the well so that the coiled tubing can be run into the well;

performing well intervention work with the coiled tubing and said first and said second jointed tubulars.

14. The method of claim 13 wherein the step of making-up the first and the second jointed tubulars includes:

supporting the jointed tubulars within said rotary table disposed within said modular support frame;

rotating the second jointed tubulars relative to the first jointed pipe in order to make-up the jointed tubular.

15. The method of claim 14 wherein the apparatus further comprises a track formed within said passage, and wherein said movable plate is slidingly attached to said track, and the method further comprises:

sliding the moving plate along the track so that the injector plate is in the position over the well;

rigging up the coiled tubing injector head to the well.

* * * * *